US006751334B2

(12) United States Patent
Håkansson

(10) Patent No.: US 6,751,334 B2
(45) Date of Patent: Jun. 15, 2004

(54) ELECTROMAGNETIC VIBRATOR

(75) Inventor: Bo Håkansson, Gothenburg (SE)

(73) Assignee: Osseofon AB, Gothenburg (SE)

( * ) Notice: Subject to any disclaimer, the term of this patent is extended or adjusted under 35 U.S.C. 154(b) by 0 days.

(21) Appl. No.: 10/237,391

(22) Filed: Sep. 9, 2002

(65) Prior Publication Data

US 2003/0034705 A1 Feb. 20, 2003

Related U.S. Application Data

(63) Continuation of application No. PCT/SE01/00484, filed on Mar. 7, 2001.

(30) Foreign Application Priority Data

Mar. 9, 2000 (SE) ..... 0000810

(51) Int. Cl.[7] ..... H04R 25/00

(52) U.S. Cl. ..... 381/396; 381/152; 381/412

(58) Field of Search ..... 381/396, 400, 381/407, 412, 414, 417, 420, 406, 152

(56) References Cited

U.S. PATENT DOCUMENTS 3,324,253 A * 6/1967 Umemura et al. ..... 381/417
5,528,697 A 6/1996 Saito
6,023,519 A * 2/2000 Tajima et al. ..... 381/412

FOREIGN PATENT DOCUMENTS

SE 514 929 5/2001
SE 514 930 5/2001
WO WO 97/09858 3/1997

* cited by examiner

*Primary Examiner*—Huyen Le
(74) *Attorney, Agent, or Firm*—Gauthier & Connors LLP

(57) ABSTRACT

The present invention relates to an electromagnetic vibrator of variable reluctance type, according to a new principle which provides higher efficiency, smaller dimension, and higher reliability compared to known technology. This has been obtained by the magnetic signal flux around the coil is closed through a bobbin body and a yoke and through air gaps formed between bobbin body and yoke(s) where a static flux from one or more of the permanent magnets and the signal flux cooperates so that static forces are outbalanced and so that axial signal forces are generated. The new vibrator principle has been names: Balanced Electromagnetic Separation Transducer (BEST).

14 Claims, 6 Drawing Sheets

ELECTROMAGNETIC VIBRATOR

This is a continuation of PCT/SE01/00484 filed Mar. 7, 2001.

TECHNICAL FIELD

The present invention relates to a bone transmitting hearing aid/bone transmitting vibrator for generating or monitoring vibrations in accordance with the variable reluctance principle comprising a coil for generating/monitoring a magnetic signal flux, a bobbin body of a magnetic conductive material, one or more yokes of magnetic conductive material, and one or more permanent magnets for generating a magnetic biassing flux.

BACKGROUND OF THE INVENTION

Bone transmitting hearing aids are used by patients who can not use conventional air transmitting hearing aids e.g., due to chronic middle ear disease or a congenital/acquired deformity. A traditional bone transmitting hearing aid consists of a bone transmitting vibrator enclosed in a polymer shell which is pressed with a constant pressure of 3–5 Newton against the skin over the bone behind the ear. Microphone, amplifier, and current source are placed in their own enclosure at a suitable site and at a secure distance from the vibrator to avoid feed-back coupling problems. The most essential drawbacks of this type of bone transmitting hearing aids is that it is uncomfortable to wear due to the constant pressure and that the soft skin over the bone deteriorate the transmission of vibrations to the bone.

Since the beginning of the 1980's there is a new type bone transmitting device—a bone anchored hearing aid (BAHA)—where the bone transmitting vibrator is connected directly to the bone via a skin penetrating and bone anchored implant of titanium, cf e.g., SE-A-81 07 161-5, SE-A-94 04 188-6 or Tjellström & Håkansson, The Bone Anchored Hearing Aid—Design principles, indications, and long-term clinical results, Otolayngol. Clin. N. Am. Vol. 28, No. 1, (1995). In this way a bone transmitting hearing aid is obtained which provides for higher amplification, splendid carrying comfort, and where all parts can be enclosed in the same housing. In a future solution the vibrator can be implanted completely and thereby skin and soft tissue can remain intact. Signal and necessary energy can in this case be transferred through intact skin by means of inductive connection. At more severe hearing damages where the energy demand is large the energy can be transferred by means of skin penetrating (percutaneous) electric connection device, cf e.g., SE 9704752-6. The advantages implanting the whole vibrator into the temporal bone compared with a vibrator being externally situated is, besides the pure medical ones, that an increased sensitivity is obtained, the size of the externally placed unit becomes smaller and stability margins becomes improved.

It is of course of utmost importance that BAHA vibrators in general and implantable ones in particular are (1) efficient, to keep current consumption down, (2) small, in order to be able to be placed in the temporal bone, and (3) reliable, as a repair/exchange of the vibrator requires a surgical incision. The need to improve conventional bone transmitting hearing aids in the above mentioned respects is perhaps the most important motif behind the present invention.

Another area of application where the bone transmitting vibrator is used is within clinical audiometry. At a conventional audiometry examination both air transmitting and bone transmitting threshold values are regularly determined The vibrator used at bone transmitting audiometry is of the same kind as used for bone transmitting hearing aids with the difference that the audiometry vibrator shall be capable of determining bone thresholds down to 250 Hz. It is commonly known the vibrators of today to be used in audiometry, e.g., B71 from Radio Ear, shows dissatisfactory high distorsion at low frequencies due to an intrinsic problem of this construction. Thus even here there is a great demand for improving the technology.

Vibrators based on piezo electricity, magnetostriction (magnetic elongation), and electromagnetism of the moving coil type are not used in bone transmitting hearing aids or audiometry vibrators mainly due to bad response at low frequencies. The devices used are electromagnetic vibrators of the variable reluctance type.

Prior Art

A cross-section of a conventional (State of the Art) vibrator of variable reluctance type of hitherto known type is shown in FIG. 1. The vibrator of FIG. 1 is substantially circularly symmetric. It consists of on one hand an annular permanent magnet, a coil coiled around an annular bobbin body, as well, and a counter mass connected in a suitable manner to a rigid unit (lower part), and on the other hand of a vibrator plate connected with a spring elemnt and a suitable adapter for connection to the load (top part). The bobin body and the vibrator plate are made of magnetic field well conductive material, suitably special treated soft iron. The vibrator plate functions as a yoke closing both the static (biassing) magnetic flux $\Phi_0$ generated by the permanent magnet and the signal flux $\Phi$_ generated by a signal current flowing through the coil. The total development of force in the air gap is determined under certain presumptions approximatively by $$F_{tot} \propto (\Phi_0+\Phi)^2 = \Phi_0^2 + 2.\Phi.\Phi_0 + \Phi^2 \qquad \text{Equ. 1}$$

The term $\Phi_0^2$ represents the static force of the permanent magnet, the term $2.\Phi.\ \Phi_0$ represnts the useful signal flux and the term $\Phi^2$ represents a non-desired distortion. The primary task of the counter mass is to add mass to obtain a suitable resonance frequency fr according to the relation $$f_r \propto 1/\sqrt{m.c}\ \text{Hz} \qquad \text{Equ. 2}$$

Wherein m is the mass of the lower part of the vibrator (including the outer rigid part of the spring element) and c is the compliance (resilience) of the spring element. In the following the mass m is called the counter holding unit. The resonance frequency may, e.g., in accordance with Equ. 2 be lowered by increasing the weight of the counter holding unit (m) or increasing the compliance of the spring element (c).

Drawbacks at Conventional Variable Reluctance Vibrator

Of the above description it is evident that a conventional variable relucatance vibrator is construed in such a way that the magnetic signal flux coincides/follows the static flux (biassing flux) along is entire run, cf FIG. 1. It leads to the fact that the properties of the electrodynamic change deteriorate as permanent magnets as a rule have a low relative permeability r (low permeability provides for a high magnetic flux resistance, which decreases the generation of signal force).

In order to prevent that the air gap which is created between the vibrator plate and the lower part of the vibrator does not collapse due to the static force ($\mu\Phi_0^2$) a spring element is required that keeps the parts apart. This spring element consists normally of a plate spring package with or without dampening coating as described in SE-A-85 02426-3. In resting condition which corresponds to an air gap of 50 to 100 nm the spring is so bent out to such a degree that its returning force exactly balances the attracting force of the permanent magnet. The Attraction force of the permanent magnet thus all the time strives to reduce the air gap created by balancing the magnet force and the spring force. Ageing of the spring as well as outer mechanical strains may thus lead to that the air gap of the vibrator collapses. If this should occur the sound of the vibrator becomes strongly distorted and the vibrator has to be repaired.

Another problem is that this type of vibrator, at higher signal levels, creates a high harmonic distortion of the second order due to the term $\Phi_^2$, cf Equ. 1. In order to obtain a good linearity a high biassing flux ($\Phi_0$) is required, which requires high stiffness of the returning spring which in turn leads to a higher resonance frequency. This increase of the resonance frequency can be counteracted by increasing the counter holding mass (cf Equ 2) but at the price of increased weight and size.

Balanced Armature

In order both to be able to maintain a high biassing flux and simultaneously to use a softer returning spring one has, since long, used a so called Abalanced armature@-principle, cf e.g., U.S. Pat. No. 3,491,436 by Elmer V. Carlsson when constructing small loud speakers for placement in the auditory meatus (generation of air spread sound). The thin arm (Aarmature reed") of soft iron material which also functions as returning spring, is placed between two permanent magnets. In the middle position the magnets draw equally much and the arm is situated in a balanced position. The demand on the spring constant of the returning spring will hereby become much smaller than if a magnet circuit of the traditional type was to be used. These transducers are adapted to drive a light weight membrane for air borne creation of sound and the construction can not be transferred to a bone transmitting vibrator the load and working conditions (i.e. the skull bone) differ considerably from air. Further, the signal flux is hereby not only lead through the soft iron material and the air gap but also through the permanent magnet material which as a rule possesses a high reluctance (magnetic flux resistance) relative to the soft iron material.

SUMMARY OF THE PRESENT INVENTION

The proposed invention is a new vibrator of variable relectance type which is characterized in that the signal flux is closed through the bobbin body and yoke as well as by two or more common air gaps where biassing flux and signal flux cooperates for generating the signal force. Both the bobbin body and yoke are made of material which leads magnetism very well, such as e.g., specially prepared soft iron material. The permanent magnets generating biassing flux can be placed in many different ways under the condition that the biassing flux in each embodiment is led in such a way that it cooperates with the signal flux in the air gaps for generating the signal force in accordance with Equ. 1. Different from known technology the signal flux, in the proposed solution herein, is closed through the soft iron material and air gaps without passing the permanent magnet(s). One advantage using this solution is that the efficiency of the vibrator is improved as the permanent magnets, as mentioned above, in general have bad dynamic (signal providing) properties compared with the soft iron material.

Another advantage is that the static flux cooperates in the air gaps according to the principle of Abalanced armature@ so that the static forces eliminates each other. This means that the vibrator can be made smaller for a given resonance frequency as the returning spring (the spring element) can be softer as it need not counteract any static force in the neutral position and the counter mass can thus be lighter, i.e., smaller to a corresponding degree.

Another advantage using the balanced armature is that even the quadratic distortion terms will be outbalanced. Most of all it is due for the second harmonic overtone which otherwise can be very dominating at low frequencies, which is particularly annoying at audiometry vibrators.

The return to neutral position is secured by one or more spring elements. The spring elements can e.g., consist of plate springs with or without dampening coating. Furthermore the air gap can be provided small elastic pillows to provide for a progressive resiliency which also provides a soft restriction (compression) of high sounds. The pillows in the air gap counteracts the possibility to air gap collapse as well.

In the two embodiments of the invention described in detail below, the coil and the permanent magnet(s), as different from known technology, been split in a new way which has been made possible due to the balanced hanging. In one unit the generation of the magnetic signal (coil and bobbin body) flux is carried out, and in the other unit the generation of the magnetic biassing flux (permanent magnet (s) and yoke) is carried out. The spring element connects the two units while observing, as described above, that it is formed two or more air gaps between the units where the static forces are outbalanced and where magnet bias and signal flux cooperate for generating the signal force. The advantage splitting the units in this way is that vibrational stress on the thin connecting lines to the coil become minimal as the coil via the bobbin body is connected to the skull bone which has a very high mechanical impedance (Hakansson et al, The mechanical point impedance of the human head, with and without skin penetration, J. Acoust. Soc. Am., Vol. 80, No. 4, October 1986). At resonance frequency the counteracting unit will swing with relatively large amplitudes while the coil moves relatively little and transfers, mainly, forces only. High reliability when it comes to the durability of the lines of the coil will be of utmost importance when the vibrator is implanted.

The application of the invention is not restricted to bone transmitting hearing aids but can, with advantage, also be used as audio metry vibrator and other loudspeaker applications as well as vibration provider.

DETAILED DESCRIPTION

Figure 1:
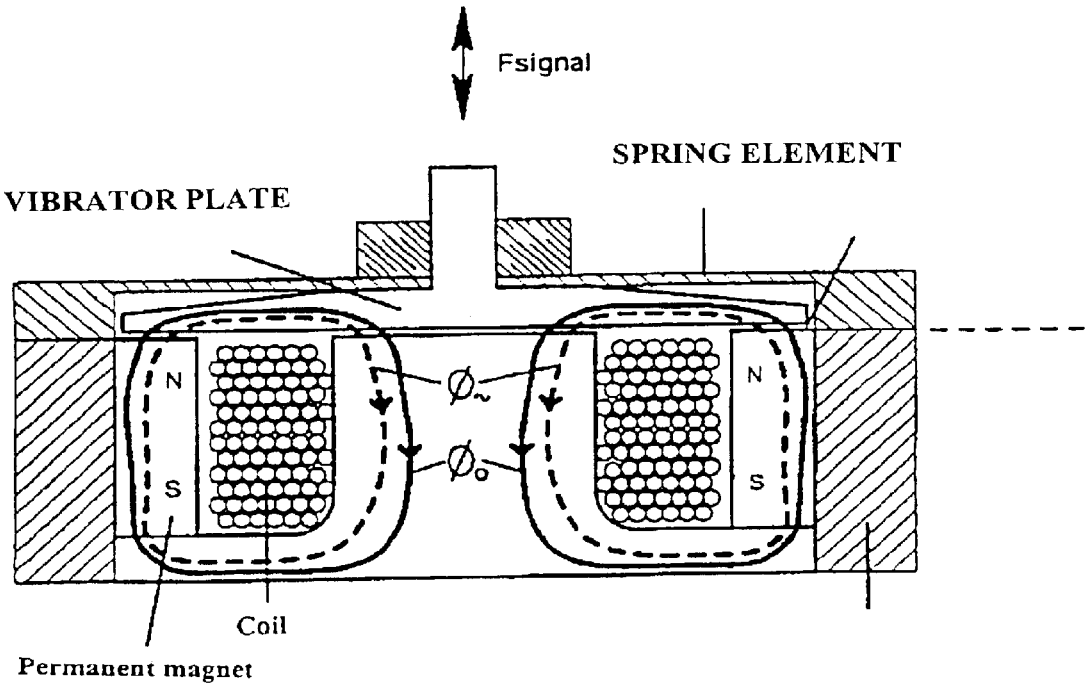
Fig.1 (Prior Art)
FIG. 1: Prior art—cross-section of a conventional variable reluctance vibrator
Figure 2:
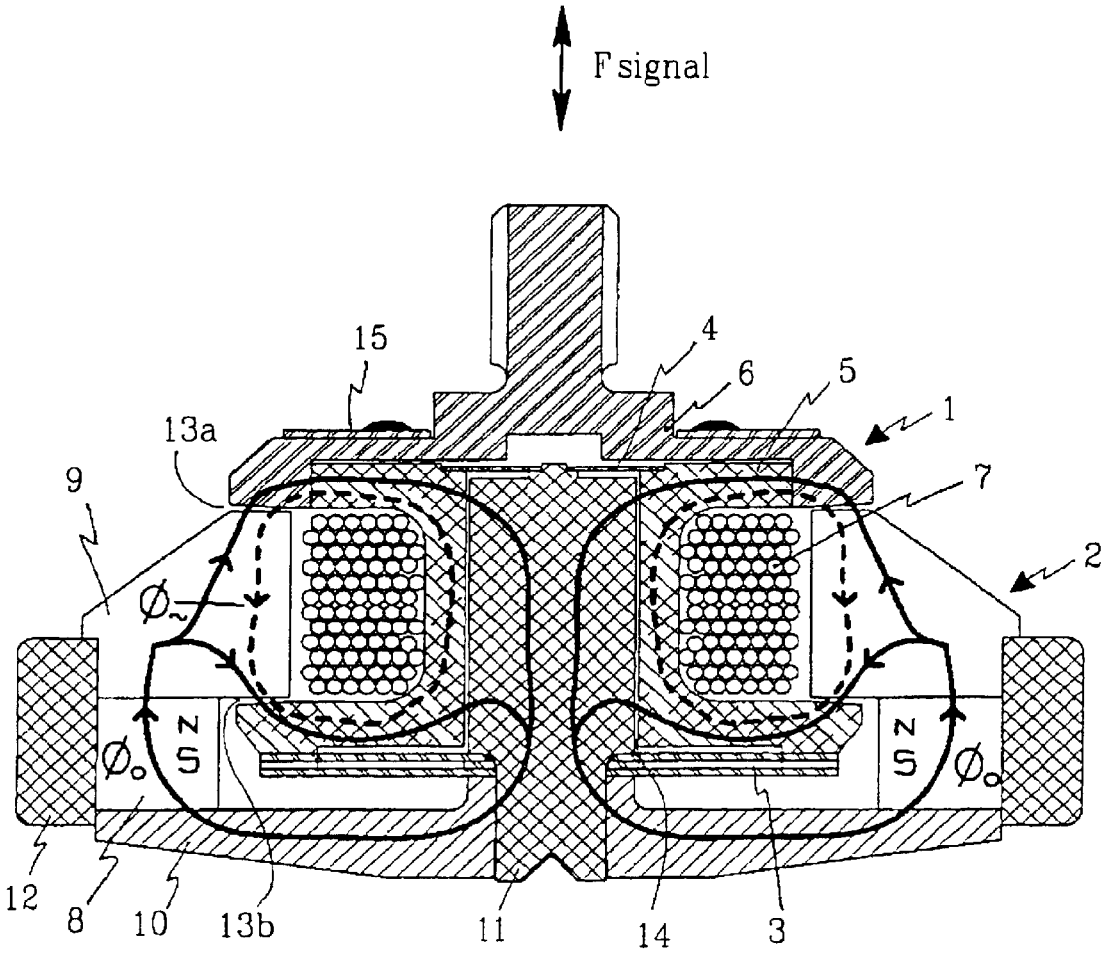
FIG. 2: Cross-section of a first embodiment of the invention

A first embodying example according to the present invention is shown in FIG. 2. The picture of the embodiment has a substantially circular symmetry. The vibrator consists of a generation unit 1 of signal flux and a biassing flux unit 2 which are elasticly bound to each other by means of a plate spring element 3 and a guiding spring 4. The generation unit of signal flux 1 consists of a bobbin body 5, adapter yoke 6, and a coil 7, all been fixedly attached to each other. The fact that the upper arm of the bobbin body 5 is shortened for being adaptable to the adapter yoke 6 is only dependent upon the fact that it shall be simple to mount the circular yoke 9. From a magnetic point of view the bobbin body and the adapter yoke to be regarded as an integral unit. The biassing flux unit 2 consists of permanent magnet 8, yoke 9, bottom plate 10, pole 11, and counteracting mass 12, all fixedly connected to each other. Between the generation unit 1 of signal flux and the biassing flux unit 2 there are created circular radially extending axial air gaps 13*a* and 13*b*, through which the biassing flux $\Phi_0$ and the signal flux $\Phi__$ are led in such a way that the axial forces in the air gaps, acting between the units, works in push-pull mode. The term axial direction means the direction which is parallel to the direction shown by the double directed arrows which shhow the direction of the signal force ($F_{signal}$) of FIGS. 1–6.

The effect of this solution is evident from Equ. 3–5 below:

$$F_1 \propto \left(\frac{\Phi_0}{2} + \Phi_-\right)^2 = \frac{\Phi_0^2}{4} + \Phi_- \cdot \Phi_0 + \Phi_-^2 \qquad \text{Equ. 3}$$

$$F_2 \propto \left(\frac{\Phi_0}{2} - \Phi_-\right)^2 = \frac{\Phi_0^2}{4} - \Phi_- \cdot \Phi_0 + \Phi_-^2 \qquad \text{Equ. 4}$$

$$F_{tot} = F_1 - F_2 = F_{signal} \propto 2.\Phi_0.\Phi__ \qquad \text{Equ. 5}$$

As evident the two static forces ($\Phi_o^2/4$) and the distortion term ($\Phi__^2$) will become outbalanced and the remainder is the axially directed signal force $F_{signal}$, se Equ 5. A very important advantage using this construction is that the signal flux is substantially closed through soft iron 5, 6, 9 without passing the permanent magnet 8. In this embodying example the signal flux way around the coil also shortest possible which is important to reduce the iron losses. Completely independent of the signal flux circuit the permanent flux $\Phi_0$ can be controlled by varying the thickness of the radial air gap 14.

The connecting lines of the coil is soldered to the circuit board 15. As the coil and coil lines are fixedly connected to the adapter yoke, which in turn is conected to the skull bone which has a very high mechanical impedance, the mechanical stress on the coil lines will be minimized. That part of the vibrator which will show large vibration amplitudes is the rigid and vibrational insensitive counteracting unit.

It is important to note that the flux lines in the embodying example described herein are only symbolically drawn and describe in which parts the main flux runs. In reality the fluxes are distributed across the cross-section surfaces and leakage outside the physical components exist. In this embodiment the leakage of signal flux which takes place through the permanent magnet to add to the generation of signal force when it passes the upper air gap 13*a*.

Figure 3:
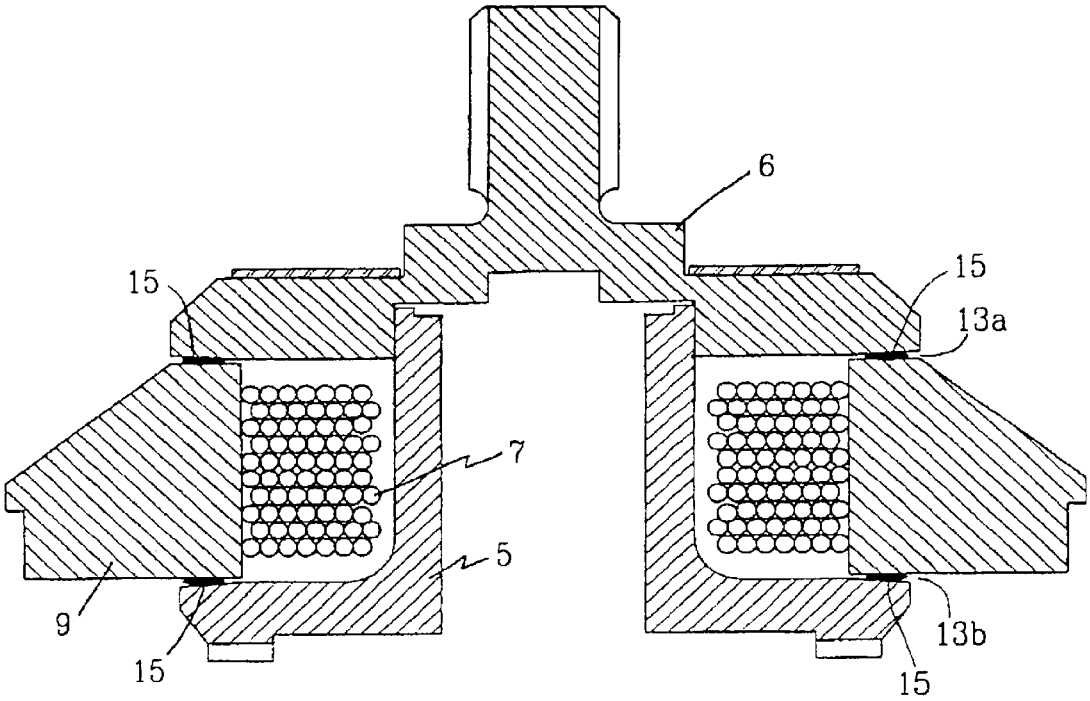
FIG. 3: Details of the first embodiment

In FIG. 3 it i shown that the air gaps 13*a* and 13*b* can be provided with cushions of a suitable elastic materil 15, e.g., silicone rubber, which prevents collapse of the air gap. Further, there is shown that the air gaps can be formed by somewhat inclined surfaces in order to better distribute the magnetic fluxes in the air gaps and to prevent air gap collapse. Finally, in FIG. 3 it is shown that the coil 7 can be fixedly attached in a simple way to the yoke 9 in stead of to the bobbin body 5 using a suitable glue.

Connection to the load (e.g., a titanium fixture implanted into the temporal bone or the house in an audiometry vibrator) can be made either via the signal flux unit 1 or the biassing flux unit 2. In the embodiment disclosed here (FIG. 2) a connection to the signal flux unit is shown only.

In the above description of the vibrator it is supposed to be completely circular symmetric but it can likewise be rectangular symmetric. At rectangular symmetry the yoke 9 and the permanent magnet 8 are divided into two parts. The one pair of the yoke and the permanent magnet (now being rectangular as to their form) is fitted into the left opening of the bobbin body and the other pair of yoke and permanent magnet is fitted into the right opening in the same way as shown by the cross-section of FIG. 2.

By using, as in this first circular symmetric embodiment (FIGS. 2 and 3) only one magnet a construction is obtained which will obtain less possible geometric dimensions. The construction has, however, turned out to be hard to produce, and it is hard to inspect and control the radial air gap 14. Further it is requested a relatively stiff spring to secure that the balanced air gaps are maintained as this middle point is unstable from a force point of view.

Figure 4:
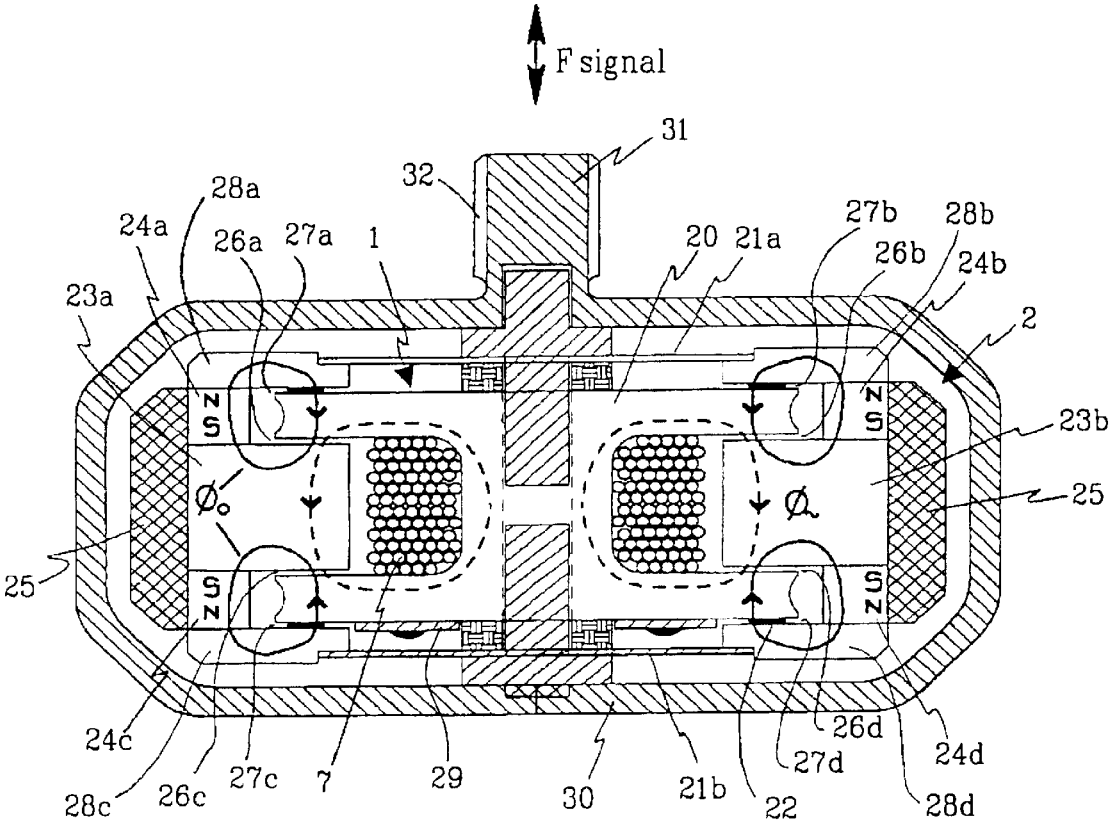
FIG. 4: A second and preferred embodiment of the invention

In FIG. 4 there is shown a second and preferred embodying example which completely or partly solves the drawbacks of the first embodiment. The vibrator has hereby a rectangular symmetry but can also be realized using circular symmetry. The now totally integral H-formed bobbin body 20 is elastically hanged using two spring elements 21 to the biassing flux uunit 22. The biassing flux unit consists of two yokes 23, four magnets 24*a, b, c, d*, four biassing yokes 28*a, b, c, d*, and a counter acting mass 25. Each magnet biases the neighbouring inner air gap 26*a, b, c, d*, but the biassing flux runs through the outer air gaps 27*a, b, c, d*, and the through the bias yokes 28*a, b, c, d*, as well. The spring element 21 can be made as plate springs with or without dampening coating. One or more of the air gaps can also here be provided with an elastic material e.g., silicone rubber to prevent air gaps collapse (not shown in FIG. 4). The circuit board 29 for soldering the lines of the coil 7 to, is fixedly connected to the bobbin body to avoid unnecessary vibrational stress on the connecting lines.

An substantial advantage using this embodiment compared to the one according to FIG. 2 is that the mounting becomes easier and that the trimming of suitable air gaps and bias flux to provide a stable and optimal signal force development is facilitated. The air gaps can be inspected from the outside as well.

Another advantage using this construction where the bias flux runs through both the inner 26 and the outer 27 air gaps are, that the return to the middle point (the balanced position) becomes more easy as a reduced inner air gap (e.g., 26*a*) compensates by a simultaneously increased outer air gap 27*a*. Finally, all leakage of signal flux through the permanent magnet via the outer air gaps is fully utilized at signal force generation.

If the vibrator shall be implanted it can be housed in a shell 30 of a tissue compatible material e.g., titanium. The housing consists, suitably, of two halves which are laser welded together (not shown in FIG. 4). The shell has a protrusion 31 with e.g., threads 32 for connection to the load.

As previously mentioned the permanent magnets can, to produce a static flux, be placed in a number of different ways. For example the magnets, besides the positions 24*a, b, c, d*, also be placed according to 40*a, b, c, d* or 41*a, b*, in FIG. 5 or according to 50*a, b, c, d*, of FIG. 6. The embodiments according to FIGS. 5 and 6 can have rectangular or circular symmetry.

Figure 5:
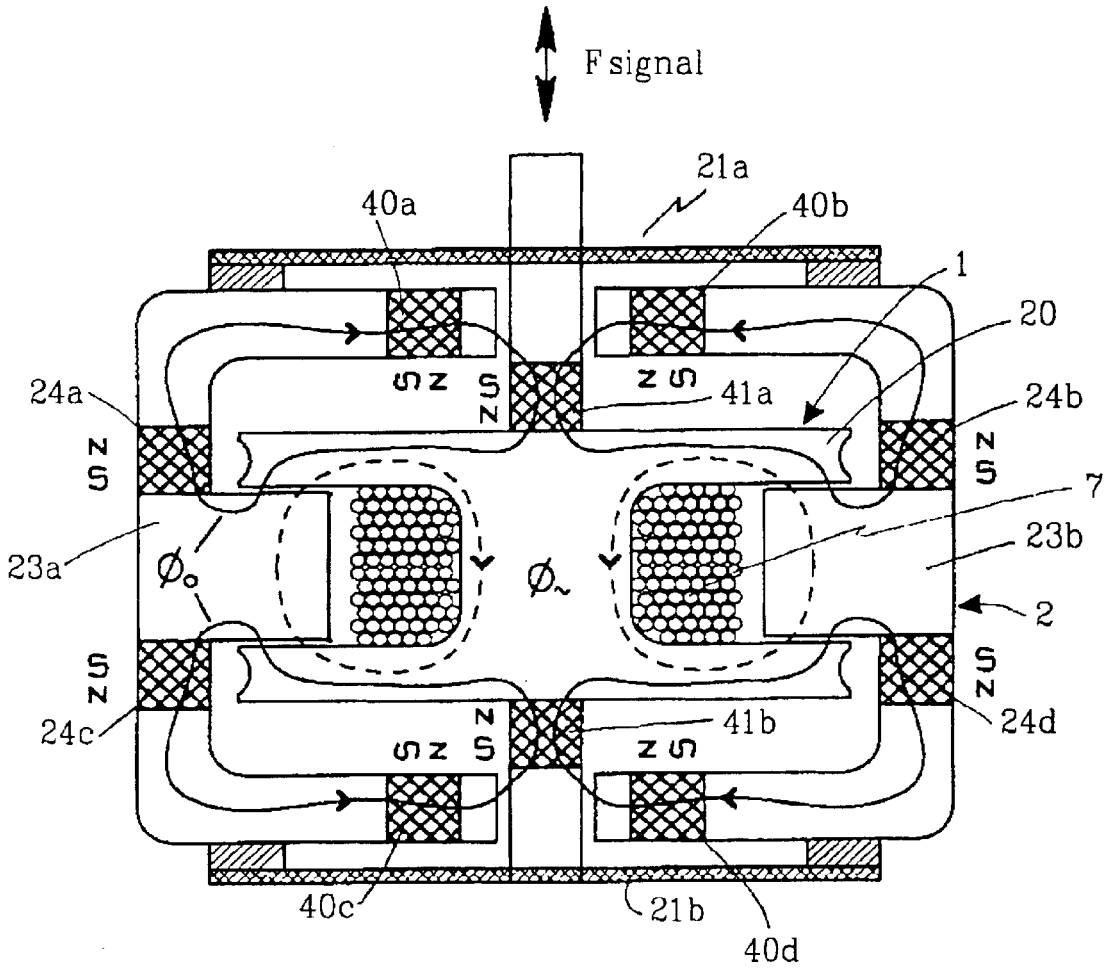
FIG. 5: A general embodiment showing different magnet positions
Figure 6:
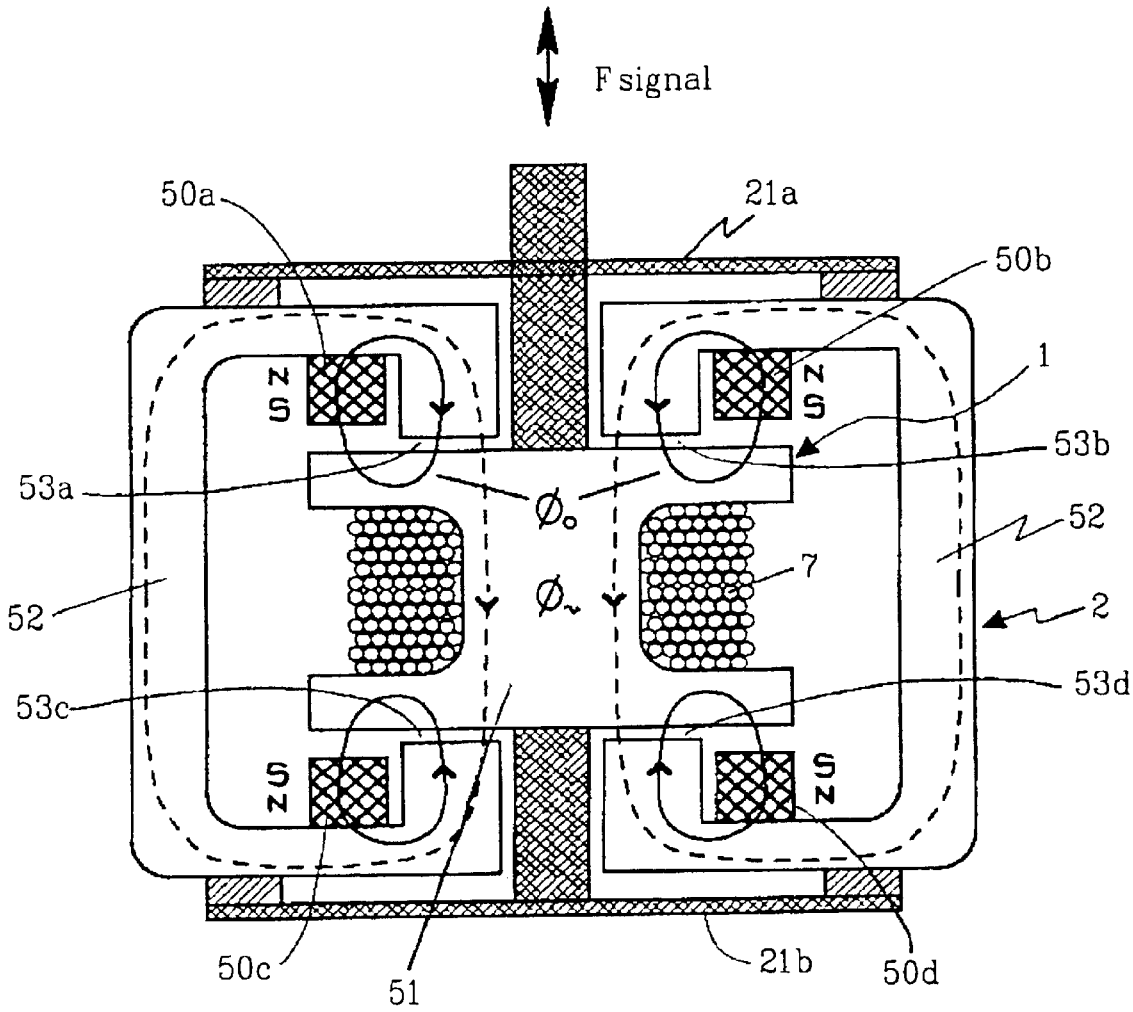
FIG. 6: A general embodiment showing Aouter@ air gaps only.

The embodiments of FIGS. 2, 4 and 5 have a H-shaped bobbin body where the signal forces are developed mainly in air gaps which are formed between the yoke(s) and the inner sides 13*a, b* and 26*a, b, c, d*, of the arms of the H-shaped bobbin body—which are here called inner air gaps. In the embodiment of FIG. 6 the signal forces are developed in air gaps shaped on the outside 53*a, b, c, d*, of the arms of the H-shaped bobbin body 51—which are called outer air gaps. A drawback of the embodiment of FIG. 6 may be that the magnetic signal flux way through the yoke 52 becomes longer than in the other embodiments and thereby the losses in the iron material can be expected to be larger. Another drawback is the leakage of the signal flux through the magnets 50*a, b, c, d* may reduce the signal force generation.

It is evident from the embodiments of FIG. 2, 4, 5, 6 each individually or in combination that there are a number of different possibilities to realize/introduce biassing flux from the permanent magnets. The technical effect and the specific solution of the signal flux circuit including the air gaps and the interaction with biassing flux to generate the signal force is the same in all embodiments.

In spite of the fact that all embodiments have been presented to describe the invention it is evident that the one skilled in the art may modify, add or reduce details without diverging from the scope and basics of the present invention as defined in the following claims.

What is claimed is:

1. A device for generating or monitoring vibrations in accordance with the variable reluctance principle consisting of a coil for generating/monitoring a magnetic signal flux, a bobbin body of a magnetic conductive material, one or more yokes of magnetic conductive material, and one or more permanent magnets for generating a magnetic biassing flux, wherein the signal flux being generated/monitored by the coil is closed through the bobbin body and the yoke(s) as well as through two or more air gaps created between yoke(s) and bobbin body, and wherein the permanent magnet(s) are arranged in such a way that its/their static flux coincides with and cooperates with the signal flux of the air gaps so that the static forces between the yoke(s) and the bobbin body are outbalanced and so that axial signal forces are generated or axial movements are monitored, alternatively, between the yoke(s) and the bobbin body by voltage induced in the coil.

2. A device according to claim 1, wherein the air gaps are axial.

3. A device according to claim 2, wherein the axial air gaps are substantially radially extending.

4. A device according to claim 1, wherein the coil can be fixed either to the bobbin body or the yoke(s).

5. A device according to claims 4, wherein the bobbin body is H-shaped and that the air gaps are formed at the inside and/or at the outside of the arms and yoke(s) of the H-shaped bobbin body.

6. A device according to claims 5, wherein the bobbin body, yoke(s) and magnet(s) are made according to circula or rectangular symmetry.

7. A device according to claim 6, wherein the yoke(s) and bobbin body are resiliently conected to each other by means of one or more spring elements having suitable elastic properties to secure a stable air gap and to provide the desired resonance frequency.

8. A device according to claim 7, wherein the spring element are plate springs provided with dampening mass.

9. A device according to claim 8, wherein elastic and dampening cushions are provided in one or more of the air gaps.

10. A device according to claim 1 further comprising a first unit containing a soft iron material and one or more permanent magnets for generating magnetic biasing flux and a second unit containing soft iron material and a coil for generating a magnetic signal flux, wherein the units are resiliently connected to each other by means of one or more spring elements having elastic properties to secure a stable air gap and to obtain a resonance frequency.

11. A device according to claim 10, wherein the spring elements are plate springs provided with dampening mass.

12. A device according to claim 11, wherein cushions having elastic and dampening properties are arranged in one or more of the air gaps.

13. A device according to claim 10, wherein the device is enclosed in a shell of tissue compatible material, such as titanium.

14. A device according to claim 13, wherein the shell consists of two halves being laser welded together.

* * * * *